US008366400B2

(12) United States Patent
Ochiai et al.

(10) Patent No.: US 8,366,400 B2
(45) Date of Patent: Feb. 5, 2013

(54) COMPRESSOR ROTOR

(75) Inventors: Hiroyuki Ochiai, Tokyo (JP); Takashi Furukawa, Tokyo (JP); Mitsutoshi Watanabe, Tokyo (JP); Tetsuji Fujimura, Tokyo (JP)

(73) Assignee: IHI Corporation, Tokyo (JP)

( * ) Notice: Subject to any disclaimer, the term of this patent is extended or adjusted under 35 U.S.C. 154(b) by 495 days.

(21) Appl. No.: 11/944,560

(22) Filed: Nov. 23, 2007

(65) Prior Publication Data

US 2008/0226460 A1 Sep. 18, 2008

(30) Foreign Application Priority Data

Nov. 24, 2006 (JP) ..... P2006-317489

(51) Int. Cl.
*F01D 5/20* (2006.01)

(52) U.S. Cl. ..... 416/228; 416/241 R; 415/173.4; 415/174.4

(58) Field of Classification Search ..... 415/173.1, 415/173.3, 173.4, 174.4; 416/228, 241 R
See application file for complete search history.

(56) References Cited

U.S. PATENT DOCUMENTS

| | | | | |
|---|---|---|---|---|
| 899,319 | A * | 9/1908 | Parsons et al. | 415/173.5 |
| 4,390,320 | A * | 6/1983 | Eiswerth | 416/97 R |
| 4,744,725 | A * | 5/1988 | Matarese et al. | 415/173.4 |
| 4,878,810 | A * | 11/1989 | Evans | 416/203 |
| 4,957,411 | A | 9/1990 | Girault | |
| 5,286,168 | A | 2/1994 | Smith | |
| 5,456,576 | A * | 10/1995 | Lyon | 415/173.3 |
| 6,059,530 | A * | 5/2000 | Lee | 416/97 R |
| 6,206,642 | B1 * | 3/2001 | Matheny et al. | 416/230 |
| 6,887,036 | B2 * | 5/2005 | Ohara et al. | 415/173.4 |
| 6,896,485 | B2 * | 5/2005 | Ohara et al. | 415/173.4 |
| 2004/0091627 | A1 * | 5/2004 | Ohara et al. | 427/402 |
| 2004/0241003 | A1 * | 12/2004 | Roy et al. | 416/236 R |
| 2008/0134504 | A1 * | 6/2008 | Schoenenborn | 29/889.1 |

FOREIGN PATENT DOCUMENTS

| | | | |
|---|---|---|---|
| EP | 0 291 407 | A1 | 11/1988 |
| EP | 0 919 699 | A2 | 6/1999 |
| EP | 0 919 699 | A3 | 6/1999 |
| EP | 1 221 537 | A2 | 7/2002 |
| EP | 1 221 537 | A3 | 7/2002 |
| EP | 1 391 537 | A1 | 2/2004 |
| EP | 1 624 192 | A1 | 2/2006 |
| EP | 1 785 214 | A2 | 5/2007 |
| GB | 2 310 897 | A | 9/1997 |
| JP | 49-98602 | | 8/1974 |
| JP | 1-159401 | | 6/1989 |
| JP | 7-180502 | | 7/1995 |

(Continued)

OTHER PUBLICATIONS

Office Action issued Mar. 28, 2011, in Japan Patent Application No. 2006-317489 (with English translation).

*Primary Examiner* — Edward Look
*Assistant Examiner* — Aaron R Eastman
(74) *Attorney, Agent, or Firm* — Oblon, Spivak, McClelland, Maier & Neustadt, L.L.P.

(57) ABSTRACT

A blade as a main body of a rotor blade has a suction side made convex and a pressure side made concave so as to have an aerofoil profile. A squealer tip having a back face continuous to the suction side and a front face matching with a center plane of the blade is formed at a distal end of the blade. The front face is coated with a hard coating.

7 Claims, 4 Drawing Sheets

FOREIGN PATENT DOCUMENTS

| | | |
|---|---|---|
| JP | 8-284884 | 10/1996 |
| JP | 2000-345809 | 12/2000 |
| JP | 2004-150272 | 5/2004 |
| WO | WO 2004/010005 A1 | 1/2004 |
| WO | WO 2004/033755 A1 | 4/2004 |
| WO | WO 2006/084438 A1 | 8/2006 |

* cited by examiner

COMPRESSOR ROTOR

CROSS-REFERENCE TO RELATED APPLICATIONS

This application is based upon and claims the benefit of priority from the prior Japanese Patent Application No. 2006-317489 (filed Nov. 24, 2006); the entire contents of which are incorporated herein by reference.

BACKGROUND OF THE INVENTION

1. Field of the Invention

The present invention relates to a rotor of a compressor applied to a gas turbine engine.

2. Description of the Related Art

Gas turbine engines are employed as power sources of jet airplanes and have compressors each having stators and rotors arranged axially alternately. A rotor has a plurality of rotor blades arranged at even intervals in a circumferential direction, each of which is directed obliquely to both the front direction and the rotating direction so as to compress air aftward by rotation thereof. In each blade, a face directed forward is to suck air and therefore referred to as a suction side and another face directed aftward is to compress air and referred to as a pressure side. To increase a compression effect, the suction side is made convex and the pressure side is made concave, more specifically each blade has a so-called aerofoil profile.

A distal end of each blade is often coated with a hard coating having abrasiveness as it has frictional contact with an inner face of a case of the compressor. Here, the term "abrasiveness" with respect to a member means a quality of abrading an opposite member (the case of the compressor in this case) which is in frictional contact with the member. Because of the abrasiveness of the hard coating, as the opposite member preferentially wears in comparison between the distal end and the opposite member, the distal end is protected from deterioration by frictional contact. Japanese Patent Application Laid-open No. 2000-345809 discloses a related art.

SUMMARY OF THE INVENTION

The blades of the rotor are given a repeating vibration during operation of the compressor. The repeating load caused by the repeating vibration generates repeating stretching and compressive stresses on both the suction side and the pressure side of each blade. These repeating stresses may cause occurrence of fatigue cracks in the main body of the blade or the hard coating coated thereon. The cracks in the blade or the hard coating are likely to extend over the entire blade and therefore cause severe reduction of the fatigue lifetime of the blade. The present invention has an object to prevent cracks reduced by vibration and resultantly provide a rotor blade of a compressor having an improved lifetime.

The inventors had carried out intent studies on repeating stretching and compressive stresses and points of origin of cracks to achieve the above object. As a result, the inventors made findings that hardness of the hard coating causes cracks and also the hard coating is likely to be points of origin of cracks because the coating is disposed at an utmost surface on the blade where repeating stretching and compression are the most severe. Finally, the inventors reached a conclusion that to form a face under substantially no stress at a distal end of the blade and to coat a hard coating on the face may lead to a prominently improved fatigue lifetime.

According to an aspect of the present invention, a rotor applied to a compressor of a gas turbine engine is provided with a blade having a suction side and a pressure side; a squealer tip formed in a unitary body with a distal end of the blade, the squealer tip including a first face continuous to the suction side and a second face matching with a center plane of the blade; and a coating covering the second face.

Preferably, the squealer tip further has a leading face and a trailing face, both of which are continuous to the second face and do not match with the center plane of the blade, and the coating further covers the leading face and the trailing face. Further preferably, the second face includes points respectively correspondent to ¼ and ¾ of a chord length from a leading edge to a trailing edge of the blade. Still preferably, the coating includes any material selected from the group of tungsten carbide, titanium carbide and silicon carbide. Alternatively preferably, the coating is formed by any method selected from the group of a spraying method, a physical vapor deposition method, a chemical vapor deposition method and an electric spark surface treatment method.

DETAILED DESCRIPTION OF THE PREFERRED EMBODIMENT

Figure 1:
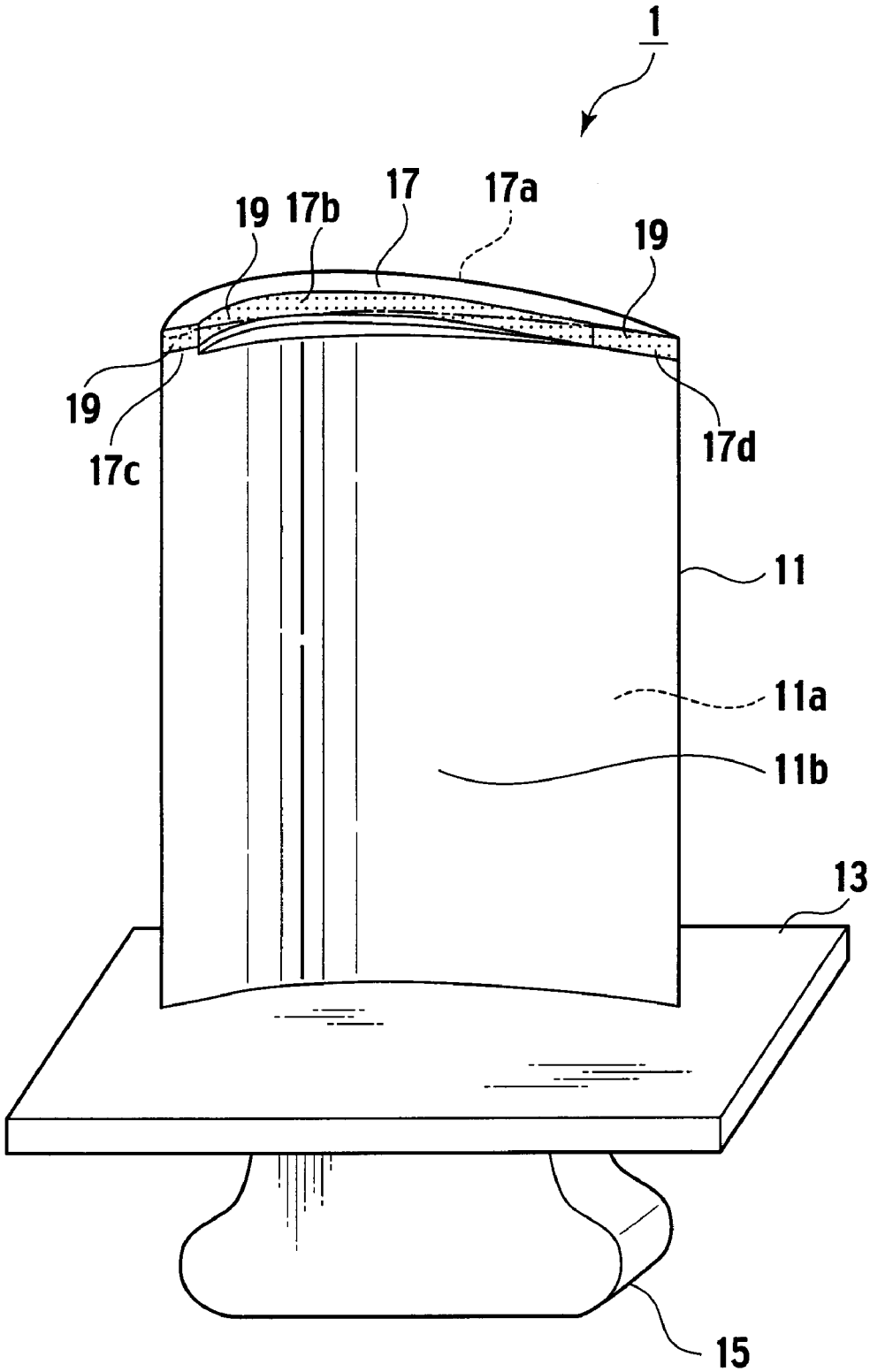
FIG. 1 is a perspective view of a rotor blade of a compressor in accordance with an embodiment of the present invention.

An embodiment of the present invention will be described hereinafter with reference to FIGS. 1 to 3. Throughout the drawings, the specification and claims, a distal end and a proximal end of the rotor blade are respectively defined as radially outer and inner ends with respect to an axis of the compressor. Further, the fore and the aft are respectively defined as directions corresponding to the upstream and the downstream in an air flow through the compressor. In FIG. 3, the fore is shown as the left and the aft as the right.

A rotor blade 1 in accordance with the embodiment of the present invention is installed in a case 5 of a compressor 3 of a gas turbine engine so as to rotate unitarily with the disk 7 around an axial center C as shown in FIG. 3. A plurality of rotor blades 1 are arranged at even intervals in a circumferential direction. In the axial direction, the rotor blades 1 and the stator vanes 9 are alternately arranged.

Each rotor blade 1 has a blade 11 as a main body thereof. The rotor blade 1 has a platform 13 at a proximal end thereof unitarily and also a dovetail 15 at a further proximal end thereof unitarily. The blade 11 has a suction side 11*a* made to be convex and a pressure side 11*b* made to be concave at an opposite side thereto. More specifically, the blade 11 forms an aerofoil profile at a plane perpendicular to the radial direction. The platform 13 is in a rectangular plate-like shape and the platform 13 along with adjacent platforms forms a circumferential face around the axial center C. The dovetail 15 is so structured as to engage with the disk 7.

As shown in FIGS. 1 and 2, the distal end of the blade 11 unitarily has a squealer tip 17. The squealer tip 17 is a portion which is made thinner than the main body. Its back face 17*a* is continuous to the suction side 11*a* and its front face 17*b* is a face stepped back from the pressure side 11*b* and curved in leading and trailing directions to be a concave face. Further, the front face 17*b* of the squealer tip 17 is made to match with a center plane (and an extrapolation thereof; the same will be applied hereinafter). In FIG. 2, as being cut by the cross sectional face, the center plane is shown as a line L. The center plane is a mechanically neutral face which is free from strain even when the blade 11 is deformed to bend. Meanwhile, throughout the specification and claims, the term "matching" does not mean perfect matching exclusive of any error, but means and is used as matching to a degree permitting unavoidable error in view of technical and economical views by one skilled in the art.

Figure 2A:
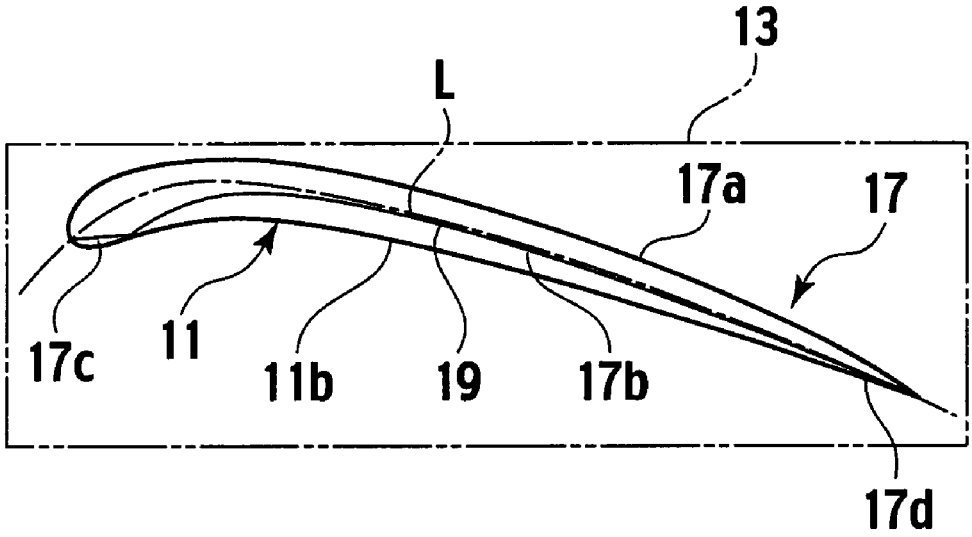
FIGS. 2A and 2B are cross sectional views of a part ranging from a distal end to the middle of the rotor blade.
Figure 2B:
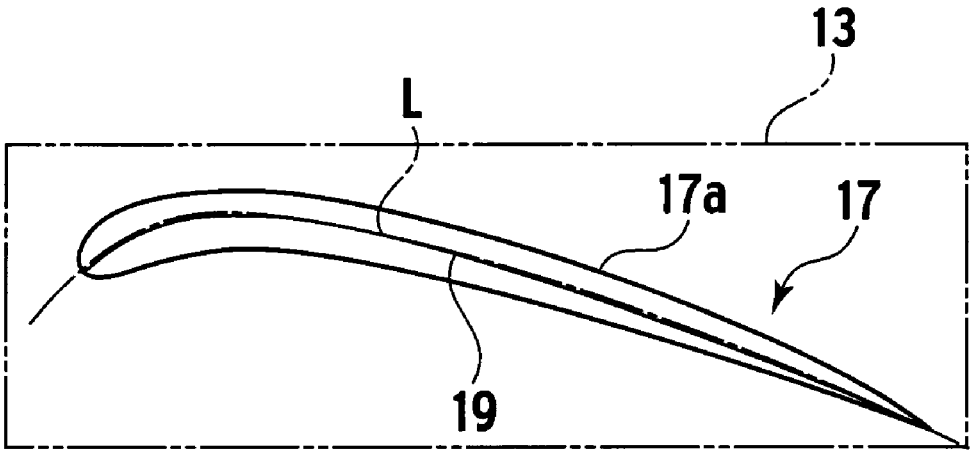
Figure 3:
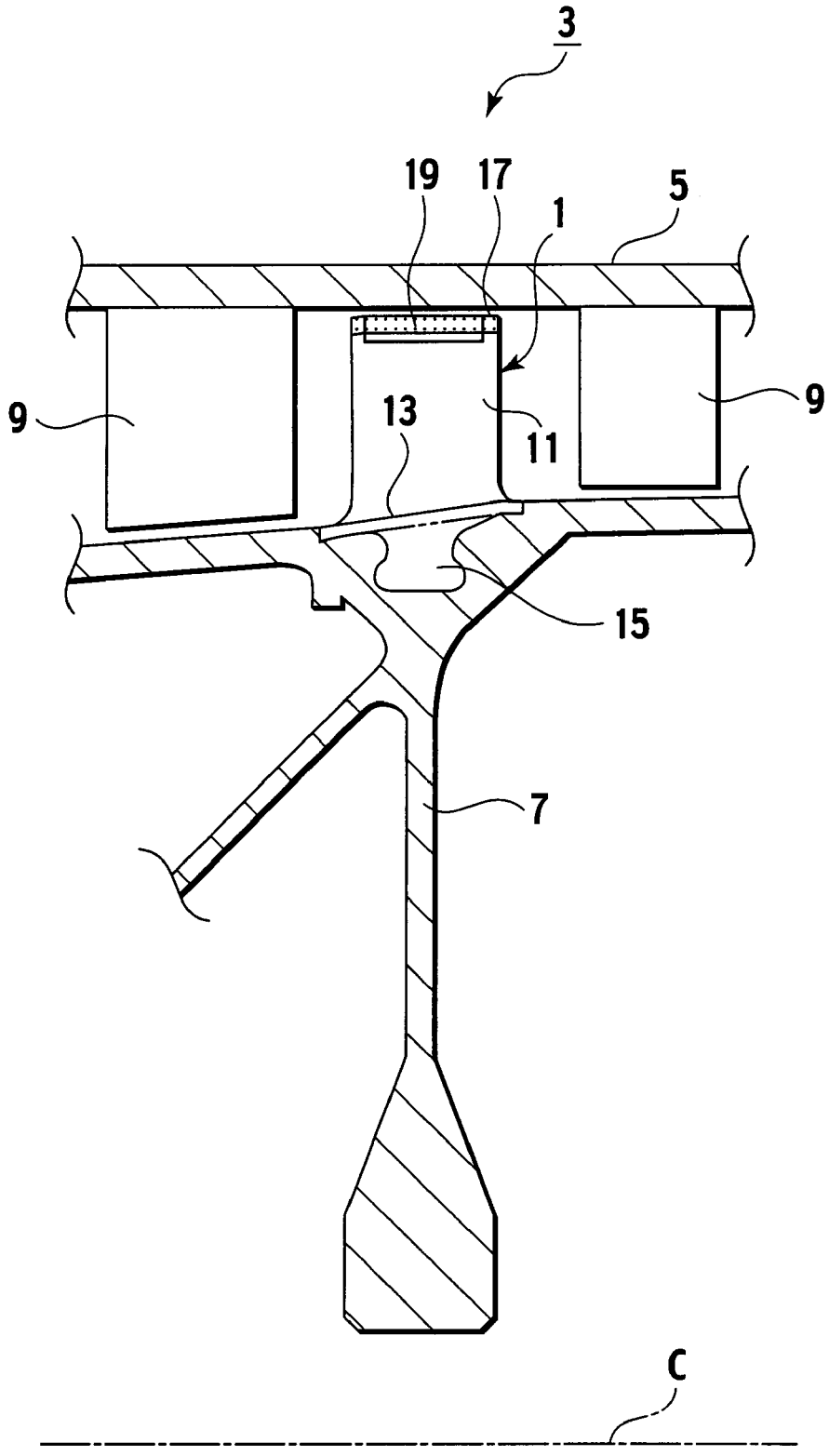
FIG. 3 is a cross sectional view of apart of the compressor including the rotor blade.

The front face 17*b* and the center plane may be made matched with each other from the leading edge through the trailing edge as shown in FIG. 2B, or alternatively they may be made matched with each other at least at parts thereof except vicinities of the leading edge and the trailing edge as shown in FIG. 2A. In a case of FIG. 2A, a leading face 17*c* and a trailing face 17*d* of the squealer tip 17 may be made to be continuous to the pressure side 11*b*.

The squealer tip 17 reduces possibility of occurrence of cracks in a hard coating thereon. If the squealer tip 17 is made to be too low in height, it is uneasy to carry out coating. If it is made to be too tall, performance as a blade is reduced and cracks in the hard coating may easily occur. Therefore, height of the squealer tip 17 in the radial direction may be from 0.5 mm to 4.0 mm. Further, a corner of the squealer tip toward the pressure side may be rounded. Radius of the rounded corner may be made greater so as to reduce stress concentration on the angle.

The front face 17*b* is coated with the hard coating 19. If the squealer tip is formed in the shape shown in FIG. 2A, the coating 19 may cover not only the front face 17*b* but also the leading face 17*c* and the trailing face 17*d*. Further, the hard coating 19 may cover any faces other than the leading face 17*c* and the trailing face 17*d*.

The hard coating 19 is formed by any coating method such as spraying, and consists essentially of one or more materials selected from the group consisting of WC (tungsten carbide), TiC (titanium carbide), SiC (silicon carbide) so as to have abrasiveness.

Meanwhile, "abrasiveness" is a quality of abrading an opposite member (the case 5 in this case) which is in frictional contact and in return being protected from deterioration by the frictional contact as the opposite member preferentially wears. As the hard coating 19 having abrasiveness covers the front face 17*b*, when the distal end of the rotor blade 1, namely the squealer tip 17, comes into frictional contact with the inner periphery of the case 5 during the compressor 3 is in operation, the inner periphery of the case 5 wears and in return the rotor blade 1 is protected from deterioration by frictional contact. As materials having abrasiveness, hard ceramics such as carbides and nitrides and further ceramics containing abrasive particles such as cubic boron nitride can be exemplified. More particularly, tungsten carbide, titanium carbide and silicon carbide can be exemplified.

The hard coating 19 may be formed by any method selected from proper coating techniques of spraying, physical vapor deposition (PVD), chemical vapor deposition (CVD), electric spark surface treatment (micro spark coating: MSC) and such. If thickness of the hard coating 19 is too small, the hard coating 19 may likely wear out in a relatively short term or may be hard to be formed without any defects. If the hard coating 19 is too thick, it gives rise to occurrence of cracks caused by a repeating thermal cycle or such. As proper thickness depends on quality of the coating and the quality depends on which coating technique is applied, resultantly the thickness should be determined on which coating technique is applied. In a case where the hard coating 19 is formed by spraying, the thickness is preferably from 0.025 mm to 0.15 mm. Alternatively in a case where MSC is used for forming the hard coating 19, the thickness of the coating 19 is preferably from 0.002 mm to 0.025 mm. Further in a case where the coating is formed by PVD or CVD, the thickness is preferably from 0.002 mm to 0.005 mm.

As described above, even when repeating stretching and compressive stresses generated by vibration of the rotor blade 1 acts on the blade 11, the center plane is nearly free from stretching and compression as the center plane is a mechanically neutral face. As the front face 17*b* of the squealer tip 17 is so formed as to at least partly match with the center plane, the hard coating 19 formed on the front face 17*b* is also nearly free from stretching and compression. Thereby occurrence of cracks in the hard coating 19 caused by vibration-induced fatigue is prevented and accordingly the lifetime of the rotor blade 1 of the compressor is elongated.

The aforementioned embodiment can be modified as the needs arise. For example, whereas the mechanically neutral plane is made to be the center plane in the aforementioned description, a geometrically central plane, or any plane or any curved surface having affinity with the neutral or center plane, which may be mechanically or geometrically uniquely-definable, may be applied to the plane with which the front face 17*b* matches in a case where the center plane is uneasy to be defined or machining of the squealer tip 17 along the center plane is uneasy to be carried out. Even though such a plane or a surface does not accurately match with the mechanically neutral face, as the plane or the surface is sufficiently close thereto and hence stretching and compression are extremely suppressed, an effect that fatigue induced by vibration is suppressed can be enjoyed.

When the blade 11 vibrates, standing waves having nodes positioned at the leading and trailing edges thereof are likely to be generated. As positions corresponding to antinodes of the standing waves suffer from the greatest stretching and compression, these positions on the hard coating 19 may be susceptible to fatigue. Therefore, when positions corresponding to the antinodes are calculated on the basis of vibration analysis of the blade 11, the positions corresponding to the antinodes may be included in a range where the front face 17*b* of the squealer tip 17 matches with the center plane of the blade 11. Among the standing waves, the fundamental wave having a longest wavelength which is corresponding to a length from the leading edge to the trailing edge should be primarily taken into consideration, however, the first harmonic, the second harmonic, or any higher mode harmonics may be taken into consideration. Further in a case where the vibration analysis is uneasy to be carried out because of difficulty caused by a shape, points respectively corresponding to ¼ and ¾ of a chord length from the leading edge to the trailing edge may be regarded as the antinodes and these points may be included in the range where the front face 17*b* of the squealer tip 17 matches with the center plane of the blade 11.

To demonstrate the effects, the following tests had been carried out.

Figure 4A:
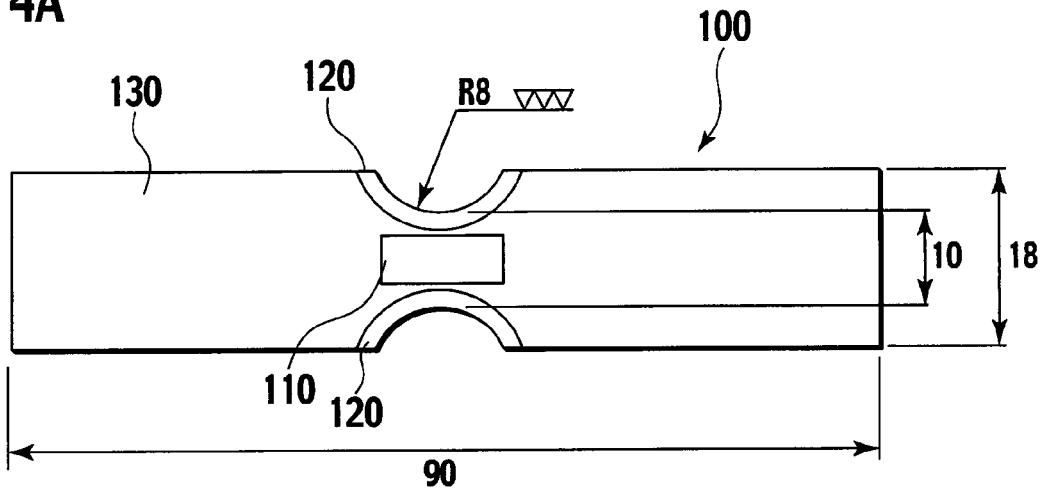
FIGS. 4A-4C are outlines of a fatigue test piece.
Figure 4B:
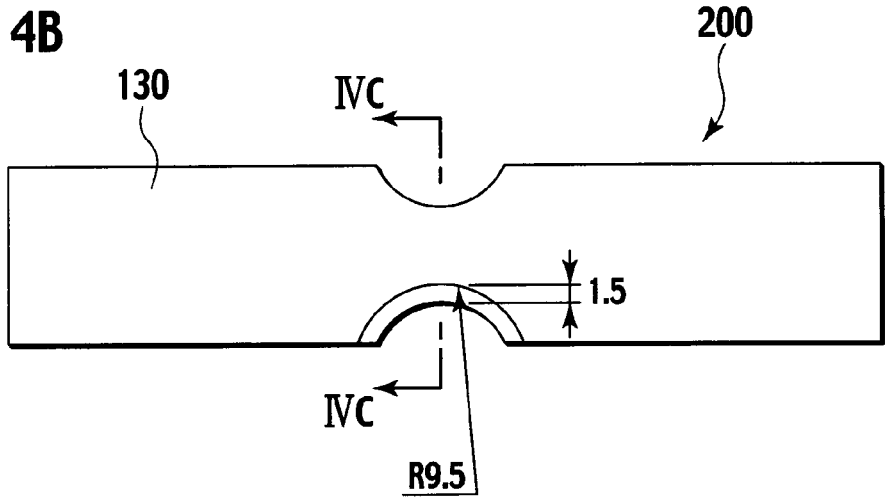
Figure 4C:
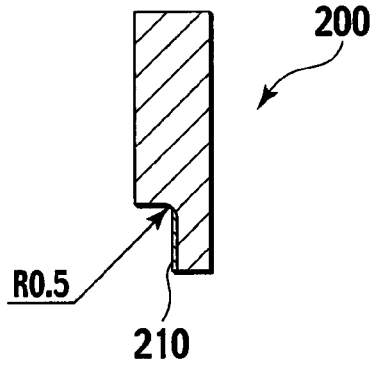

A metal mass of INCONEL 718 was machined into cold bending fatigue test pieces as shown in FIG. 4(*a*). These pieces were finished into a so-called three-triangle finishing of generally used finish marks. Subsequently, both faces of cites referred to the reference numeral 120 were treated with shot peening, and both faces of remaining cites 130 were treated with glass bead peening. Those without a hard coating (test pieces 1), and those coated with a hard coating of TiC on the cites 110 (although only on one of the faces) by MSC (test pieces 2) were prepared. Further, test pieces of the identical material and having the identical shape, each of which had one of paired narrowed portions machined and thereby reduced into half in thickness as simulating a squealer tip as shown in FIG. 4B, were produced. Those without a hard coating and those with a hard coating of TiC as shown in FIG. 4C were prepared. Cold bending fatigue tests were executed by loading repeating stress of 25 Hz in frequency and 680 MPa on the four kinds of these test pieces. Results are shown in Table 1.

TABLE 1

Fatigue test results

| Test piece number | Simulated squealer tip | Hard coating | Stress (MPa) | Frequency (Hz) | Cycle for fracture |
|---|---|---|---|---|---|
| 1 | None | None | 680 | 25 | 769000 |
| 2 | | Formed | | | 217000 |
| 3 | Formed | None | | | 64300 |
| 4 | | Formed | | | 59000 |

As being understood from comparison between the test pieces 1 and 2, the fracture lifetime of the test piece with the hard coating is decreased down to about 30 percent of that without the hard coating. On the basis of these results, promotion of fracture of the test piece 2 may be understood as results of that: the hard coating is likely to generate points of origin of cracks because the hard coating is harder than INCONEL 718 as the base body and exists at the surface where stretching and compression are the most severe; and these cracks extend into the base body. On the other hand, as being understood from comparison between the test pieces 3 and 4, whether existence or non-existence of the hard coating in the test pieces having simulated squealer tips causes small difference in the fracture lifetime. These results can be understood as meaning that, if the hard coating is coated on the squealer tips, cracks are unlikely generated in the hard coating because the squealer tips are nearly free from stretching and compression, and therefore the crack lifetimes of the test pieces as a whole are not affected. Meanwhile, the fact that the crack lifetimes of the test pieces 3 and 4 are shorter than those of the test pieces 1 and 2 is caused by that the shape of the test pieces is too severe in view of fatigue, and has no relation with the nature of the present invention.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A rotor applied to a compressor of a gas turbine engine, comprising:

a blade having a suction side and a pressure side;

a squealer tip formed in a unitary body with a distal end of the blade, the squealer tip including a first face continuous to the suction side, a second face matching with a mechanically neutral surface of the blade, and a third continuous face directly connecting the first and second faces; and a coating covering the second face.

2. The rotor of claim 1, wherein the squealer tip further includes a leading face and a trailing face, both the leading face and the trailing face being continuous to the pressure side and not matching with the mechanically neutral surface of the blade, and the coating further covers the leading face and the trailing face.

3. The rotor of claim 2, wherein a corner of the squealer tip toward the pressure side is rounded.

4. The rotor of claim 1, wherein the second face includes points respectively correspondent to ¼ and ¾ of a chord length from a leading edge to a trailing edge of the blade.

5. The rotor of claim 1, wherein the coating includes any material selected from the group of tungsten carbide, titanium carbide and silicon carbide.

6. The rotor of claim 1, wherein the coating is formed by any method selected from the group of a spraying method, a physical vapor deposition method, a chemical vapor deposition method and an electric spark surface treatment method.

7. The rotor of claim 1, wherein the mechanically neutral surface of the blade is a surface of the blade which is free from strain when the blade is deformed to bend.

* * * * *